US007459185B2

(12) United States Patent
Gutowski et al.

(10) Patent No.: US 7,459,185 B2
(45) **Date of Patent: *Dec. 2, 2008**

(54) TREATMENT OF NATURAL POLYMER BASED MATERIALS AND THE PRODUCTS BASED THEREON

(75) Inventors: Wojciech Stanislaw Gutowski, Victoria (AU); Lee Joy Russell, Victoria (AU); Alexander Bilyk, Victoria (AU); Pamela Maree Hoobin, Victoria (AU); Sheng Li, Victoria (AU); Con Filippou, Victoria (AU); Mark Spicer, Victoria (AU)

(73) Assignee: Commonwealth Scientific and Industrial Research Organization, Campbell, Australian Capital Territory (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/965,255

(22) Filed: Oct. 15, 2004

(65) Prior Publication Data

US 2005/0048207 A1 Mar. 3, 2005

Related U.S. Application Data

(60) Division of application No. 10/201,626, filed on Jul. 24, 2002, now Pat. No. 6,830,784, which is a continuation of application No. PCT/AU01/00100, filed on Feb. 5, 2001.

(30) Foreign Application Priority Data

Feb. 4, 2000 (AU) ..... PQ5449

(51) Int. Cl.
*B05D 1/36* (2006.01)

(52) U.S. Cl. ..... 427/308

(58) Field of Classification Search ..... None
See application file for complete search history.

(56) References Cited

U.S. PATENT DOCUMENTS

| | | | | |
|---|---|---|---|---|
| 3,401,049 | A * | 9/1968 | Horowitz | 427/302 |
| 3,477,902 | A | 11/1969 | Tomasino et al. | |
| 3,513,055 | A * | 5/1970 | Brader, Jr. et al. | 427/412.2 |
| 3,542,707 | A * | 11/1970 | Wilkinson | 524/47 |
| 3,650,811 | A | 3/1972 | Nordstrom et al. | |
| 4,696,830 | A | 9/1987 | Obayashi et al. | |
| 5,300,192 | A | 4/1994 | Hansen et al. | |
| 5,344,462 | A | 9/1994 | Paskalov et al. | |
| 5,382,323 | A | 1/1995 | Furman, Jr. et al. | |
| 5,421,866 | A | 6/1995 | Stark-Kasley et al. | |
| 5,543,487 | A * | 8/1996 | Vick et al. | 528/158 |
| 5,576,076 | A | 11/1996 | Slootman et al. | |
| 5,593,738 | A | 1/1997 | Ihm et al. | |
| 5,693,411 | A | 12/1997 | Hansen et al. | |
| 5,872,190 | A | 2/1999 | Gutowski et al. | 525/359.4 |
| 5,879,757 | A | 3/1999 | Gutowski et al. | 427/491 |
| 5,985,372 | A | 11/1999 | Saka et al. | 427/387 |

FOREIGN PATENT DOCUMENTS

| | | | |
|---|---|---|---|
| DE | 19858736 | A1 | 6/2000 |
| EP | 0427317 | B1 | 3/1997 |
| EP | 0812956 | A1 | 12/1997 |
| EP | 0964093 | B1 | 8/2007 |
| GB | 2279272 | A | 4/1995 |
| JP | 46-011446 | * | 3/1971 |
| JP | 53-20403 | | 2/1978 |
| JP | 55-158908 | | 12/1980 |
| JP | 2-307986 | | 12/1990 |
| WO | 9419526 | A1 | 9/1994 |
| WO | 9967466 | A1 | 12/1999 |

OTHER PUBLICATIONS

Trout, TAPPI, 34(12), pp. 539-544, 1951.*

Translation of Reizin et al, Tr. Inst. Lesokhoz. Probl. Drevesiny, Akad. Nauk Latv. SSR, 25, pp. 107-116, 1963.*

Suzuki et al, Mokuzai Gakkaishi, 21(8), pp. 473-479, 1975.*

Ghosh et al., "Journal of Applied Polymer Science," 31(5), pp. 1499-1507, 1986.

Cho et al., "Polymeric Materials Scioence and Engineering," 62, pp. 48-51, 1990.

Reizin et al., "Tr. Inst. Lesokhoz. Probl. i Khim. Dresesiny, Akad. Nauk Latv. SSR, 25", pp. 107-116, 1963.

Gray, "Paper Synthetics Conference Proceedings," pp. 67-82, 1979.

Allen, "Modification of wood wettability by plasma and corona treatments," Int'l Journal of Adhesion & Adhesives 20(2000), pp. 103-111.

(Continued)

*Primary Examiner*—Erma Cameron
(74) *Attorney, Agent, or Firm*—Pillsbury Winthrop Shaw Pittman LLP

(57) ABSTRACT

A method for modifying a substrate containing a natural polymeric material to improve its interaction with other materials, the method comprising: A) Treating the substrate containing the natural polymeric material with a modifying agent selected from the group consisting of organo-functional coupling agents and multi-functional amine containing organic compounds; and B) optionally exposing the substrate containing natural polymeric material with one or more treatments selected from the group consisting of: i) subjecting the substrate to extraction with a solvent to reduce the content of extractable materials associated with the natural polymeric material prior to or during treatment with the modifying agent; ii) treatment with a physical field selected from static physical fields, high-frequency alternating physical fields and combinations of two or more thereof either prior to, during or after treatment with the modifying agent; and iii) oxidation of at least part of the natural polymeric material prior to or during treatment with the modifying agent.

14 Claims, No Drawings

OTHER PUBLICATIONS

Wertheimer et al., "NSERC . . . Industrial Research Chair on 'Low Pressure Plasma . . . of Materials,'" Plasmas and Polymers, vol. 2, No. 1, 1997, pp. 53-64.

Shaker et al., "Improvement of the Interfacial Adhesion Between Kevlar Fiber and Resin by Using R-F Plasma," Journal of Composites Technology & Research, 1996, pp. 249-255.

Carlsson et al., "Adhesion between Plasma-treated Cellulosic Materials and Polyethylene," Surface and Interface Analysis, vol. 17, pp. 511-515, 1991.

Partial European Search Report, dated Jun. 29, 2004 in corresponding EP application, 12 pp.

* cited by examiner

TREATMENT OF NATURAL POLYMER BASED MATERIALS AND THE PRODUCTS BASED THEREON

This application is a divisional of U.S. application Ser. No. 10/201,626, filed Jul. 24, 2002, now U.S. Pat. No. 6,830,784 which was a continuation of PCT/AU01/00100, filed Feb. 5, 2001, both of which are incorporated herein by reference.

The present invention relates to a method of modifying natural polymeric materials to improve their ability to interact with other materials.

BACKGROUND OF THE INVENTION

Natural polymeric materials are polymeric materials from biological systems or derived from biological systems. Examples of natural polymeric materials include; polysaccharides, such as cellulosic materials and starch based materials; protein based materials; polymers derived from monomers that occur in biological systems but are prepared using synthetic methods; and polymers produced by micro-organisms.

Polysaccharides constitute the major proportion of plant structural material and include cellulose, and its derivatives, starches, pectins and hemicelluloses. Cellulose is the most abundant polysaccharide and constitutes one half of the weight of perennial plants. Cellulosic materials such as plant material, wood, wood and wood-based products, paper and other substances containing natural cellulose-based fibres are one of the most important material resources and are used in a wide range of objects including buildings and their components such as cladding/sidings, window frames, doors and door frames, decking and others, furniture, clothing and paper products. Wood is not only used in its raw form but also in the form of the fibres, strands, or chipped wood are used for making pulp paper, fibreboard, plywood, oriented strand boards, laminated board, pellets, composite materials with either natural or synthetic polymeric matrix or inorganic matrix and/or binders and other products known to those skilled in the art.

The efficient and durable bonding or contact of other types of organic and/or inorganic materials such as paints, adhesives, synthetic resins, metallic coatings, electroconductive or charge transfer materials, UV-, IR-, or MV absorbing materials, inks, preservatives and composite components to natural polymeric materials is critical to the performance and longevity of these products in a number of important industrial applications. In these applications they may be applied to the surface or to the bulk of these products.

Vegetable products based on natural polymers such as cellulosic materials are often difficult to wet and bond. There use in many other specific functions is also problematic because of low surface energy, incompatibility, chemical inertness, or the presence of contaminants and weak boundary layers. The lack of adequate adhesion at the substrate/adherent and/or reinforcement/matrix interfaces often results in poor material performance and limits the possible applications of the products made with these materials. Effective surface treatments are frequently required to overcome one or more of the above mentioned difficulties in order to achieve controlled or maximized the product or composite performance and controlled level of adhesion with paints, adhesives, functional coatings, bio-active materials, or other materials.

An example of a specific application is the electrostatic painting process on cellulosic substrates which may involve organic solvent- or water-based paints or those suitable for powder-coating. The electrostatic painting process has advantages over conventional painting process as up to 80% less paint is used and the VOC can be greatly reduced when less paints are used. To satisfy the electrostatic painting requirements, the surface/interface layer of polymer based materials must possess electrical conductivity and good adhesion to both substrate and paints.

The properties of wood have a significant effect on its ability to bond with paint and other materials. The dimensional changes at the late-wood-earlywood interface can cause cracks in film-forming finishes at this zone. Paint failure on latewood often begins with these cracks. If the bands of latewood are narrow enough, as in slow growth trees, the stresses are decreased and there is less tendency for paint to crack or peel than on the wide latewood bands. Wide latewood bands are normally absent from edge-grained cedar and redwood improving the paintability of these species. It is well established that wide latewood bands on softwoods give a surface that is difficult to coat or paint or to provide other type of finishing.

Water also causes peeling of paint. Even if other factors are involved, water accelerates paint adhesion degradation. If the moisture content of the wood exceeds 20% when the wood is painted, the risk of blistering and peeling is increased.

Although the erosion of a wood surface through weathering is a slow process, the chemical changes that occur within a few weeks of machined wood storage or outdoor exposure can drastically decrease the adhesion of adhesives or paints subsequently applied to the stored or weathered surface. Wood stored for excessively long times or badly weathered, cannot hold adhesive paint very well. However, even over a period of only two to three weeks the wood may appear sound and much the same as unexposed wood but when smooth-planed boards that have been preweathered for 1, 2, 4, 8 or 16 weeks then adhesively bonded or painted, the adhesive or paint drastically losses adhesive strength after four weeks of preweathering. For panels preweathered for only one week, the paint may start to peel more quickly than unweathered wood.

Paint applications are especially susceptible to performance failures when surface checking of the wood substrate occurs. These checks initiate cracking and peeling of the coating. Kiln drying dramatically decreases this condition but is not always desirable or convenient.

It is desirable to modify the wettability of natural polymeric surfaces in many practical applications. The surfaces of articles of natural polymeric materials and their composites may also be required to exhibit a specific level or gradient of wettability by organic and/or inorganic liquids or vapours of these liquids. Depending on specific end-applications, the liquid phase or condensate may be required to form a uniform film (requiring a hydrophilic film for aqeous compositions) or alternatively, it may be required to bead-up on an unwettable liquid-repellent surface (a hydrophobic surface for aqeous compositions). It is also possible that in some instances, an intermediate level of wettability is desirable. The surface/interface with a specified or well defined wettability must overcome the adverse effects of polymer surface restructure and continuous washing cycles to remain effective.

Cellulosic materials are also used in the manufacture of composites in the form of sheets, particles or fibres, strands, woven fabrics with a synthetic resin or natural polymer-based resin or an inorganic material as a matrix or binder and optionally other filler materials. Such products have a tendency to breakdown particularly in the presence of moisture and fluctuations in temperature.

The durability of adhesion to a solid material or composite-based product or assembly subjected to high humidity, fluctuation of temperature and UV irradiation are very critical when the products are for out door application, such as unpainted or painted external components used in the building or automobile industries. The hydrothermal stability of the interface/interphase often determines the success of the surface modification process and the ultimate product performance.

Natural or synthetic polymer based materials are often required to provide surface properties such as good adhesion or chemical linkage to another material and at the same time provide a diverse range of physio-chemical properties such as strength, flexibility or elasticity, inertness or reactivity, electrical or heat conductivity, UV- or IR energy absorbance, moisture or vapour, barrier properties, biocide or fungicide functions, or wettability for various applications.

The performance and adhesion of materials such as organic, inorganic and metallic coatings, adhesives, preservatives or reinforcing resins based on natural and/or synthetic polymers and their inorganic counterparts to natural polymeric materials, particularly cellulosic materials has therefore been the subject of considerable research and development.

We have now found that the bonding of materials to natural polymeric material such as cellulosic materials can be substantially improved by modifying the natural polymer based material using certain chemicals.

SUMMARY

The invention provides a method for modifying a substrate containing a natural polymeric materials to improve its interaction with other materials, the method comprising:

A treating the natural polymeric material with a modifying agent selected from the group consisting of organo-functional coupling agents and multifunctional amine containing organic compounds; and B optionally treating the polymeric material with one or more treatments selected from the group consisting of:

i) Subjecting the substrate to extraction with a solvent, preferably water-based solvent, to reduce the content of extractable materials associated with the natural polymeric material;

ii) Exposure to a static and/or alternating physical field; and iii) Oxidation of at least part of the natural polymeric material.

Throughout the description and claims of this specification the word "comprise," and variations of the word such as "comprising" and "comprises", is not intended to exclude other additives or components or integers or steps.

DESCRIPTION

The natural polymeric material is treated with a surface modifying agent, preferably selected from the group of multifunctional amine containing compounds, organo-functional coupling agent and mixtures thereof. This modifying agent may be applied to form spray, cold or hot vapour, aerosol or as a saturating agent under ambient and/or elevated or sub-ambient pressure (eg vacuum) and any temperature in the range from room temperature up to and above the boiling point of the modifying agent or any of its ingredients.

We have also found that the long term durability of interface adhesion is remarkably improved when at least one crosslinking compound is used in combination with a polyamine containing compound or organo-functional coupling agent and applied onto the natural polymeric material to provide a cross-linked network. This invention also provides a method of activating the surface of a natural polymeric substrate to introduce chemically more reactive groups to facilitate surface tailoring. The formation of a crosslinked polyamine network has the significant advantage over the prior art as we have found that the crosslinking structure is more effective in improving the stability of chemical functionalities created on the surface. In one embodiment of the current invention functional molecules and/or fillers can be added to the crosslinkable polyamine formulation to provide surface layers with satisfactory adhesion to polymer based materials and a diverse range of other physico-chemical properties that maybe required in various applications.

To improve the overall adhesion of the modifying agent to the natural polymeric material it may be desirable to expose the natural polymeric substrate to one or more of the following treatments.

(i) Subjecting the substrate to extraction with a solvent preferably water-based solution medium to reduce the content of extractable materials associated with the natural polymeric material;

(ii) Exposing the substrate to a static and/or alternating physical field;

(iii) Oxidation of at least part of the natural polymeric material; and

For step (i) the treatment process preferably comprises preparation of a cellulosic material by subjecting the cellulosic material to extraction with a solvent or water-based medium to reduce the content of non cellulosic material attached to the surface of the cellulose such as one or more of phenolics, gums, lignin and other extractives. The extraction process preferably involves an aqueous alkali-based leaching and may include other processes that assist in increasing the efficiency of this operation. The treatment of cellulosic materials, particularly from dicotylledinous plants, by extraction has been found to significantly improve the desired interaction between the cellulosic material and modifying agent. Mixtures of the treatment agents may be used if desired.

The extraction of non-cellulosic resinous materials may be assisted by exposing the cellulosic material to high-pressure steam and/or water-based solution containing water and/or other suitable solvents. The extractant will typically include suitable chemicals capable of at least partly extracting one or more of the lignin, phenolic gums and other extractive materials present on the surface and/or within the interior of cellulose fibrils. The extraction process can be effectively assisted by the application of a static and/or alternating physical field such as heat energy and/or high-frequency alternating physical field the examples of which may be but are not limited to: microwave, radio-frequency or ultrasonic field. The extraction will most preferably use an aqueous alkali solution and may be at an elevated temperature of at least 30° C. more preferably at least 80° C.

A static or alternating external field may be applied to enhance the extraction process of step (i) or enhance the reaction between the modifying agent and the natural polymeric substrate.

The step of oxidizing the surface of the natural polymer-based or cellulosic material may utilize methods such as corona discharge, flame treatment, plasma treatment UV radiation, electron beam, ozone, excimer laser or chemical oxidation.

In a preferred embodiment the invention thus provides a method of modifying a natural polymeric material including:

contacting the natural polymeric material with (a) a polyamine containing compound or an organo-functional coupling agent reactive with the polymeric material said polyamine comprising at least four amine groups including at least two amine groups selected from primary and secondary amine groups and (b) a crosslinking agent reactive with the polyamine; to provide a crosslinked network grafted onto the natural polymeric material.

It is particularly preferred to treat the natural polymeric material to provide functional groups reactive with the polyamine or an organo-functional coupling agent. The reactive functional groups may be provided by one or more of the treatment steps referred to above involving extraction, exposure to a static and/or alternating physical field, oxidation or combination of two or more of these steps.

Surface oxidation is a particularly preferred treatment method in this aspect of the invention. Accordingly, in this preferred embodiment the invention provides a method of modifying the surface of a substrate comprising a natural polymeric material, the method comprising oxidizing the surface of the natural polymeric material to provide functional groups thereon and contacting the surface with (a) a polyamine containing compound or organo-functional coupling agent reactive with the functional groups and (b) a cross linking agent reactive with the polyamine containing compound or organo-functional coupling agent to provide a cross linked network grafted to the natural polymeric material.

The surface may be treated with the polyamine or organo-functional coupling agent and crosslinking agent in sequence or the surface may be treated with a mixture of the modifying agent and crosslinking agent.

It will be understood that the cross-linking agent may react with the polyamine before the polyamine or organo-functional coupling agent reacts with the surface functional groups. Accordingly the present invention includes an embodiment in which the polyamine or organo-functional coupling agent and crosslinkers are reacted to form a reaction product thereof which is used in contacting the surface.

Natural Polymeric Material

The natural polymeric material used for this invention include polysaccharides of which two of the most important examples are cellulose and starch based materials. Both are derived from plant based matter and for such materials, other material that naturally occurs in plant based materials may also be present. Protein based polymers are also included in this invention. For example, but not limited to, materials based casien or wheat gluten products. Natural polymeric materials may also be based on monomers found in biological systems but are prepared synthetically, one example being polymers or copolymers based on lactic acid. Another type of natural polymeric materials included in this invention are those produced by microorganisms. Examples of such materials are, but not limited to, polyhydroxy alkanoates such as polyhydroxybutarate, polyhydroxyvalerate or copolymers containing hydroxy alkane acids.

The natural polymeric materials can come in a number of forms which includes fibres, particulate, sheet (eg paper), plate, board or a shaped article.

Cellulosic materials are materials which are or contain polymerised substances derived from glucose which may be associated with other natural materials such as lignin. Cellulosic materials include natural fibres of vegetable origin and products formed from these natural materials by processing into forms such as of lumber, finished timber, planks, flat sheets, films, complex shaped articles, particulate form, textiles, woven or non-woven fabrics, cordage, brushes, mats, paper, individual fibres and mixtures thereof. These can be solid mono-materials, laminated products or hybrid materials. Cellulosic fibres or wood chips may be used in composites or reconstituted wood products, particle board, laminates, wood composites, rayon and plant fibres. Examples of plant fibres which may be treated includes kemp, jute, flax, kenaf, ramie, sunn, cadillo, seed-hair fibres such as cotton, kapok, crin vegetal, sisal and piassaya.

The preferred cellulosic materials are products from perennial plants such as wood or wood-based products or any type of cellulose-based fibres or their compounds with other synthetic or natural polymers. These polymeric materials may be used as materials on their own or alternatively as part of a composite or assembly. For example a cellulosic material layer may form the uppermost part of a multi-layer laminated sandwich comprising any materials such as polymers, metals, ceramics or an organic or inorganic or metallic coating of or any type of substrate material. The term "synthetic polymer" eg used as a matrix can be any thermoset or thermoplastic material or mixtures or blends thereof.

Examples of preferred cellulose-based substrates include but not limited to softwoods, hardwoods, leaf (hard) fibers such as abaca, cantala, caroa, henequen, istle (generic), Mauritius, phormium, bowstring hemp, and sisal; Bast (soft) fibers such as China jute; flax, hemp, jute, kenaf, ramie, roselle, sunn and cardillo; Seed-hair fibers such as a cotton and kopok; Miscellaneous fibers such as broom root (roots); coir (coconut husk fiber), crin vegetal (palm leaf segments), piassava (palm leaf base fiber); viscose (cord) and softwood kraft.

Typical examples of softwood include but not limited to Western redcedar, Cypress, Redwood, Eastern white pine, Ponderosa pine, Pinus Radiata, White fir, Western hemlock, Spruce, Douglas fir and Southern yellow pine. Typical examples of Hardwood include, Eastern cottonwood, Magnolia, Yellow poplar, Locan (plywood), Yellow birch, Gum, Sycamore, American elm, White oak, Northern red oak, Mountain Ash, Spotted Gum and other types belonging to the family of Eucalypts, Jarra and other.

Cellulosic materials include derivatives of cellulose such as cellulose ethers and esters such as cellulose acetate fibres which comprise partially or fully acetylated cellulose.

There has been a large number of papers published over the years dealing with structure and properties of man-made cellulosic materials, particularly rayon fibres.

Literature reported wetting characteristics of isolated wood polymers

| Polymer | Water contact angle (° C.) | Critical Surface Tension (dynes/cm) |
|---|---|---|
| Cellulose | 34 | 35.5 |
| | 33 | — |
| | 27.8[a] | — |
| Hemicellulose | | |
| Arabinogalactan | | 33 |
| Galactoglucomannan | | 36.5 |
| Hardwood xyland | | 33-36.5 |
| Softwood xyland | | 35 |
| Lignin | | |
| Hardwood kraft 60 | | 36 |
| Softwood kraft 58 | | 37 |

[a]Relative humidity = 66%

Cellulose is the essential component of all plant-fibres.

Cellulose is the principal fiber cell-wall material of green terrestial and marine plants, produced also by a few bacteria, animals and fungi, and thus the most abundant natural material (~40% in wood, over 70% in bast and leaf fibers, 95% in cotton, 70% in the cell wall of the green alga *Valonia ventricosa*.

Cellulose is partly ordered (crystalline) and partly disordered (amorphous), presumably the result of regions of regularity and nonregularity within the elementary and microfibrils. Accessibility of cellulose is the relative ease by which the hydroxyl groups can be accessed by reactants. The amorphous regions are highly accessible and react readily, whereas the crystalline regions with close packing and hydrogen bonding can be relatively inaccessible.

Cellulose also exists in several polymorphs. Native cellulose or cellulose I, is converted to cellulose II when cellulose fibers are regenerated or treated with 12-18% NaOH solution (mercerized), and to cellulose III and cellulose IV upon being subjected to certain chemical treatments or heat.

Formula 1. Repeat unit of cellulose (b-cellobiose residue).

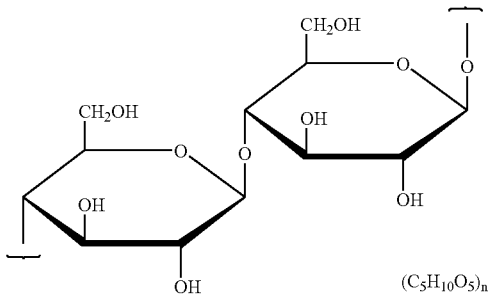

n = 1500 to >6000

Cellulose in its differing conformations exhibits differing properties. The degree of crystallinity also depends on cellulose preparation. There is not one cellulose, but a number of celluloses. It is not a compound but a material whose usefulness depends on how it has been modified by all steps prior to its final use.

Cellulose never occurs in pure form, instead it is usually embedded in lignocellulose (an amorphous matrix of hemicellulose and lignin containing ordered cellulose), making up the cell walls of fibers such as found in wood (well-developed matrix) and cotton (matrix of almost vanishing magnitude). The hemicelluloses are polysaccharides, usually branched, of various sugars and some uronic acids, which can usually be extracted from lignocellulosics with alkali. Lignins are highly cross-linked aromatic polymers, of no regular repeating unit because of their formation by free-radical condensation. Industrially useful fibers are the textile fibers: bast or stem fibers (flax, jute, hemp, ramie), leaf fibers (sisal, abaca) and the seed and fruit fibers (cotton, kapok); and the nontextile fibers (chiefly from hardwood and softwood). The geometry of the arrangement of microfibrils in fiber walls has a pronounced effect on the physical properties and thus use of these fibers.

Degrees of polymerisation ($P_n$) of different natural fibres

| Fibre | $P_n$ |
|---|---|
| Cotton | 7000 |
| Flax | 8000 |
| Ramie | 6500 |

The molecular structure of cellulose is responsible for its supramolecular structure and this, in turn determines many of its chemical and physical properties. In the fully extended molecular, adjacent chain units are orientated by their mean planes at an angle of 180° C. to each other. Thus, the repeating unit in cellulose is the anhydrocelluobiose unit and the number of repeating units per molecule is half the DP. This may be as high as 14000 in native cellulose, but purification procedures usually reduce it to something in the order of 2500.

The degree of polymerisation shows that the length of the polymer chains varies depending on the type of natural fibre.

The mechanical properties of natural fibres depend on its cellulose type, because each type of cellulose has its own cell geometry and the geometrical conditions determine the mechanical properties.

The cellulosic material used in the invention may include a cellulose derivative such as ether and ester type derivatives. Preswelling of cellulose is necessary in both etherifications (with alkali) and esterifications (with acid). The most important swelling complexes of cellulose are those with sodium hydroxide, compounds with given stoichiometric relations between alkali and cellulose. The alkali celluloses exhibit markedly enhanced reactivity compared to original cellulose. Reagents can penetrate more easily into the swollen cellulose structure and react with hydroxyl groups. Preparation of alkali cellulose (called mercerisation) is a preferred step in producing cellulose modified cellulose materials.

Lattice parameters of elementary cells in different types of cellulose

| | | Dimensions (mn) | | | |
|---|---|---|---|---|---|
| Type | Source | a | b | c | β(°) |
| Cellulose I | Cotton | 0.821 | 1.030 | 0.790 | 83.3 |
| Cellulose II | Cotton mercerised | 0.802 | 1.036 | 0.903 | 62.8 |
| | Cotton viscose | 0.801 | 1.036 | 0.904 | 62.9 |
| Cellulose III | | 0.774 | 1.030 | 0.990 | 58.0 |
| Cellulose IV | | 0.812 | 1.030 | 0.799 | 90.0 |

The constituents of hemicellulose may differ widely from plant to plant. Their chief monomer units are various ring-substituted phenyl-propanes linked together in ways which are still not fully understood. Structural details differ from one source to another. The mechanical properties are lower than those of cellulose. At the value of 4 Gpa the mechanical properties of isotropic lignin are distinctly lower than those of cellulose.

Pectin is a collective name for heteropolysaccharides, which consist essentially of polygalacturon acid. Pectin is soluble in water only after a partial neutralization with alkali or ammonium hydroxide.

The natural polymeric material can also be found in combination with synthetic polymers either as a composite, copolymer, impregnating the natural polymer with synthetic polymer or laminating. Examples of the synthetic polymeric materials suitable for impregnating or lamination with or preparing composition with natural polymeric materials for subsequent surface modification by this invention include: polyolefins such as low density polyethylene (LDPE), polypropylene (PP), high density polyethylene (HDPE), ultra high molecular weight polyethylene (UHMWPE); blends of polyolefins with other polymers or rubbers or with inorganic fillers; polyethers. such as polyoxymethylene (Acetal); polyamides, such as poly(hexamethylene adipamide) (Nylon 66); halogenated polymers, such as polyvinylidenefluoride (PVDF), polytetra-fluoroethylene (PTFE), fluorinated ethylene-propylene copolymer (FEP), and polyvinyl chloride (PVC); aromatic polymers, such as polystyrene (PS); ketone polymers such as polyetheretherketone (PEEK); methacrylate polymers, such as polymethylmethacrylate (PMMA); polyesters, such as polyethylene terephthalate (PET); polyurethanes; epoxy resins; cyano acrylate resins; and copolymers such as ABS and ethylenepropylenediene (EPDM).

Natural polymers exhibiting viscosity suitable for impregnating, coating or binding cellulose-based and other natural polymer-based solid reinforcing materials in the form of fibres, particulate or porous natural or man-made products can also be used in accordance with this invention.

Suitable natural or synthetic polymer surfaces for the application of modifying agent formulation of the current invention also include polymer containing surface reactive groups of type carboxylic, hydroxyl, anhydride, ketone, ester and epoxy introduced through bulk modification and blend with polymer containing these functionalities. The bulk modification includes but not limited to bulk grafting or reactive extrusion of polymers with monomers containing unsaturated groups such as glycidyl(meth)acrylate, maleic anhydride, maleic acid, (meth)acrylate ester. Preferable polymers are polyolefins grafted with maleic anhydride or maleic acid and glycidyl(meth)acrylate such as commercial product of polypropylene-graft-maleic anhydride, polyethylene-graft-maleic anhydride, poly(ethylene-co-glycidyl methacrylate). Typical polymer blends include polymer blended with maleated polyolefin, homopolymer or copolymer of glycidyl (meth)acrylate or maleic anhydride such as commercial products of poly(ehtylene-alt-maleic)anhydride, poly(isobutyl-alt-maleic anhydride), poly(ethylene-co-vinyl acetate)-graft-maleic anhydride.

The method of the invention may be used to modify the surface of a natural polymeric article to modify the surface properties of the article without substantially altering the bulk properties, or it may be alternatively used for the treatment of surfaces in the interior of the porous materials either occurring naturally or man-made. In this embodiment of the invention the surface of the natural polymeric article is subjected to one or more of the optional steps (i),(ii),(iii) or a combination used before, during or after being contacted with the modifying agent. The whole of the surface may be treated in this way or alternatively a portion of the surface, on which it is desired to provide modified properties, is treated. For example it may be desirable to treat only a portion of the natural polymeric article to be contacted with a material to which it is to bond.

In an alternative embodiment the natural polymeric article is treated so as to allow the modifying agent to penetrate through the entire article or a substantial portion of the article. Penetration may be enhanced by methods which open the structure of the natural polymeric material. For example treatment with alkali, relatively powerful oxidising agents or plasma tend to produce more complete penetration of the structure of a cellulosic material. Alkali tends to produce opening of the structure.

In one embodiment of the method of the invention may include at least one of: (i) extraction of soluble components of the natural polymeric material, (ii) treatment with a static and/or alternating physical field and (iii) oxidation of the material. The oxidised surface may then be exposed to the modifying agent in the presence of an alternating physical field and/or static physical field including heat energy. The surface modifying agent will generally form strong bonds to the oxidised groups on the surface of the natural polymeric material. The surface modifying agent will preferably include at least one functional group selected from the group consisting of primary amines, secondary amines, coupling agents and mixtures thereof.

The Modifying Agent

The functionality of the surface modifying agent(s) is chosen to provide good adhesion with the natural polymeric material as well as providing a surface chemical reactivity which is compatible with that of adhesive, paint, metallic coating or other material to be brought into contact with surface-modified material.

The process allows for continuous and inexpensive incorporation of a wide range of surface functional groups onto the surface of a polymeric substrate with relatively minor adaption of factory plant and equipment. This provides the possibility of tailoring the surface chemistry of a natural polymeric material, without altering its bulk properties, in order to optimise the adhesion between the surface engineered substrate and adhesive, paint, printing ink or other materials.

The method of the invention may be used to improve adhesion to a wide range of adhesive coating compositions and lacquers. Examples of resins for use with natural polymeric material modified in accordance with the invention include epoxies, acrylate, urethanes, cyanoacrylates, melameic formaldehyde and ureaformaldehyde.

The invention is useful in improving the adhesion of cellulosic material to paints and lacquers various resins in the form of matrix materials, preservation and other media providing required product performance. Suitable paints and lacquers include polymer latex, alkyds and polymethane lacquers.

The modifying agent may be a coupling agent such as those selected from but not limited to organo titanates, organo silanes and organo zirconates and organo aluminates. Particularly preferred coupling agents are of formula $X_aSiY_b$, wherein X is an non-hydrolyzable organo-functional alkyl group, Y is a hydrolysable group, a is an integer from 1 to 3, and b is 4-a: In a particularly preferred group the organofunctional silane has the structure $X_aSi(OR)_b$ where X is an non-hydrolyzable organofunctional group bonded to silicone through a stable covalent bond, R is any suitable alkyl group, preferably methyl or ethyl, a is an integer from 1 to 3 and b is 4-a. The silanol groups obtained after hydrolysis of the alkoxy groups may react with the hydroxyl and/or other functional groups introduced onto the surface of the polymer. Other functional chemical groups available in the chemical structure of an organo-functional coupling agent may also react with the surface functional groups present or introduced to the surface of a substrate.

Another preferred group of modifying agents are multifunctional amine-containing organic compounds. Such compounds will include a primary or secondary amino group and one or more other functional groups such as primary amino, secondary amino, alcohol, phenol, saccharide group or groups, carboxylic acid, aldehyde, ketone, amide, ether, ester, nitrile, nitro, thiol, phosphoric acid, sulphonic acid, halogen and unsaturated groups. Preferred modifying agents of this group include multifunctional amine containing compounds selected from the group consisting of $C_2$ to $C_{36}$ linear, branched or cyclic compounds containing two or more amine groups; polymers of a number average molecular weight of from 300 to 3 million containing a multiplicity of amine group; $C_2$ to $C_{36}$ perfluoroamines; $C_2$ to $C_{36}$ amino alcohols/phenols; $C_2$ to $C_{36}$ amino acids; $C_2$ to $C_{36}$ amino aldehydes/ketone; $C_2$ to $C_{36}$ amino amides; $C_2$ to $C_{36}$ amino ethers; $C_2$ to $C_{36}$ amino esters; $C_2$ to $C_{36}$ amino nitros; $C_2$ to $C_{36}$ amino nitrites; $C_2$ to $C_{36}$ amino phosphoric acids; $C_2$ to $C_{36}$ amino sulfonic acids; $C_2$ to $C_{36}$ amino halogens; $C_2$ to $C_{36}$ amino alkenes; $C_2$ to $C_{36}$ amino alkynes; polymers of a number average molecular weight of from 300 to 3 million containing a multiplicity of amine groups and non-amine functional groups: amino polysaccharides, etc. Specific examples of suitable coupling agents and multifunctional amines are described in our U.S. Pat. Nos. 5,879,757, 5,872,190 and Australian Patent 680716.

The most preferred modifying agents are polyfunctional amines. The polyamine compounds used in accordance with this aspect may be any compound which contains 4 or more amine groups with at least two of these amine groups being primary or secondary amines wherein primary amines have the general formula $NH_2R$ and secondary amines have the general formula $NHR_2$, where R is an any organic fragment such as an alkyl, aryl, vinyl, substituted alkyl, substituted aryl, substituted vinyl or any mixture of these etc.

The polyamine compounds may be polymeric or non-polymeric compounds. Polymeric polyamino compounds should contain multiple amine groups, at least 4, with at least two but preferably more of these amine groups being primary or secondary amines. The molecular weight of these polymers is between 200 and 2000000. In a preferred embodiment of this invention the polyamino polymers can be homopolymers containing the monomers, ethylenimine, allylamine, vinylamine, 4-aminostyrene, aminated acrylate/methacrylate, or as copolymers made from a combination of these monomers or as a copolymers containing at least one of these monomers with any other suitable monomer such ethylene, propylene, acrylate/methacrylate and ethylene oxide.

Non polymeric compounds which include linear and carbon cyclic multi amine compounds may be used. These compounds have 4 or more amine groups, with at least two of these amine groups being either primary or secondary amines. Examples of such compounds are triethylene tetraamine, tris (2-aminoethyl)amine, tetraethylene pentaamine, pentaethylene hexaamine, benzene tetraaminie.

The polyamine compounds can be used as single polyamine components or as combinations of polyamine compounds described above. A preferred embodiment of this invention is the use of polyethylenimines, i.e.: PEI compounds, linear or branched with a molecular weight range of 200 to 750000, examples of which are Lupasol FC, Lupasol WF or Lupasol PS (BASF).

The concentration of the modifying agent is between 0.000001% to 50% by weight, preferably between 0.001% and 5% by weight with the most useful concentration range being 0.01% to 1% by weight.

The modifying agent may be used as a solution in a suitable solvent such as water, alcohol or other solvent. The concentration of the solution may in many cases be very dilute. For example, concentrates as low as 0.000001 may be used although concentrates of from 0.001 to 10% are preferred. The modifying agent may be applied by any available means eg vapour spray, aerosol at the time of and/or subsequent to any of the treatment steps such as oxidation, extraction and application of a static and/or alternating physical field.

The modifying agent may be a mixture of suitable compounds. In a preferred embodiment of the invention the surface of the oxidised polymer is contacted with a first modifying agent having a relatively low molecular weight (for example from 100 to 10000) and a second modifying agent having a relatively high molecular weight. The relatively high molecular weight compound may have a molecular weight in the range of from one to eight orders of magnitude greater than the lower molecular weight compound.

Alternatively the surface of the natural polymeric material may be treated sequentially with the low and high molecular weight modifying agents.

Preferably the surface is contacted with the low molecular weight agent and then the higher molecular weight agent which may be reactive with the low molecular weight agent by virtue of the free functional groups of the grafted lower molecular weight agents.

When the combination of low molecular weight and high molecular weight modifying agents is used it is preferred that the amount of low molecular weight modifying agent is greater, preferably one to six orders of magnitude greater than the relatively high molecular weight compound.

The modifying agent may include functional groups which provide other desirable properties. Examples of these may be for instance: an inherently electroconductive group or a cluster of groups or moieties in a doped, self-doping or undoped state; UV-absorbing and/or IR and/or other energy absorbing groups or molecules; charge-containing and/or ion-exchanging group or molecule or bio-functional molecules. Alternatively any derivative of any suitable and inherently functional, eg. electroconductive, photosensitive; charge containing; UV and/or IR absorbing or other compound either low or high molecular weight, or polymer which was pre-reacted with a poly-functional amine-containing compound or silane to create either, low or high molecular weight, linear and/or branched, and/or hyperbranched compound may be used for grafting.

Following treatment with the polyamine or organo-functional coupling agent the method of the invention may further include reacting the natural polymeric surface with cross linking agents or other materials to form a network at the surface of the natural polymeric material. The extent of cross linking may be controlled to allow a certain proportion of reactive groups to remain uncross linked to provide bonding to paints or adhesives.

One of the embodiments of this invention enables the control of acid-base character of the modified substrate at any stage of processing, preferably prior to or during the application of modifying agents. This operation facilitates the control of orientation of the molecules of a modifying agent during their attachment to the oxidized surface of the substrate. An example of this procedure is the control of acid-base character of a flame treated substrate which in some cases acquires slightly acidic character during flame oxidation. The substrate's acidity is beneficial for the attachment and subsequent reaction of polyfuntional amine compounds.

In the case of an attachment of a bi-amino functional silane, it is in some cases desirable to bind one amino-functional end to the said acidic substrate, and this is accomplished with relative ease due to preferable acid-base interactions between slightly acidic carboxylic groups available at the substrate surface with amino-groups of the amino-silane.

In some cases, it is however desirable to orientate silane molecules in the manner facilitating the reaction between surface hydroxyl groups and the silicone atom. In some cases it may be beneficial to apply the said amino-functional silane from a solution exhibiting an appropriate acid-base character so that the silanol molecules are attracted to the substrate n the manner favouring the formation of a desirable bond between surface —OH groups and Si. The surface of the oxidized substrate may be contacted with an appropriate chemical prior to the said amino-functional silane application to favour the above reaction instead of facilitating the reaction involving binding of amino-groups to the surface of the substrate.

Crosslinkers for Polyamino Modifying Agents

Crosslinkers may be used in this invention to provide a crosslinked network when polyamino modifying agents are used. Crosslinkers are defined as compounds or polymers that contain at least two functional groups with at least one of these groups capable of reacting with the amino groups of the polyamino compounds so that a stable bond is formed between the polyamino compound and the crosslinker. The other functional group on the crosslinker should be able to join at least two polyamino molecules by either reacting with the amino group of another polyamino molecule or by bond formation with the functional group of another crosslinker molecule or by reaction with a co-crosslinking compound which is defined as a compound capable of bond formation with at least two crosslinking molecules. Functional groups which are suitable for initial reaction with the polyamino group include but are not limited to epoxides, anhydrides, acid chlorides, sulfonyl chlorides, ketones, aldehydes, carboxylic acids, esters, isocyanates, vinyl groups susceptible to Michael addition reactions such as acrylate, methacrylate, acrylamide, alkyl halides, alkynes etc. The other functional group, which is responsible for the final crosslinking step can be silanes, epoxides, anhydrides, acid chlorides, sulfonyl chlorides, ketones, aldehydes, carboxylic acids, isocyanates, acrylate or methacrylate esters, alkyl halides etc.

Preferably the mass ratio of polyamino compound to crosslinker is 100:1 to 1:100 with about 10:1 to 1:10 being preferred.

The type and combination of functional groups on the crosslinker is important because the crosslinker used should enable crosslinking to take place at the surface of the polymeric substrate and minimise crosslinking before application. The crosslinking reaction can be controlled by designing a system where either:

A. initial reaction with polyamino molecules is fast but the crosslinking step is slow;
B. dilute solutions are used so that crosslinking reaction is slow and is much faster when the polyamino/crosslinker formulation is concentrated on the oxidised polymeric material;
C. a reagent is used which inhibits crosslinking in solution but once the formulation is applied to the surface the inhibitor is removed;
D. mixing of the polyamino compound and crosslinker takes place prior to application on the polymeric surface;
E. a reagent or catalyst is added to the formulation that induces crosslinking of the polyamino compound just prior to application to the polymeric substrate
F. the polyamine compound and crosslinker are added in two steps;
G. a combination of these strategies is used.

Silane Crosslinking Agents

A preferred embodiment of this invention is the use of functionalised silanes which contain at least one organic functional group for reaction with the amine and a silane group which will condense with other silane groups upon addition of water, forming with SI—O—Si bonds for crosslinking. The general formula for the crosslinking silane is $X—S^1—R^1(R^2)_2$, where 1 X is any organic fragment containing at least one of the following groups; epoxide, anhydride, acid chloride, chloroformate, ketone, aldehyde, carboxylic acid, isocyanate, acrylate or methacrylate ester, acrylamide or an alkyl halide and containing form 3 to 60 carbon atoms.
2 $R^1$ is a group susceptible to hydrolysis such as an alkoxide containing 1 to 30 carbon atoms, chloride or carboxylate containing from 1 to 30 carbon atoms.
3 $R^2$ can also be a group susceptible to hydrolysis such those selected from the group consisting of an alkoxide containing 1 to 30 carbon atoms, chloride and carboxylate containing from 1 to 30 carbon atoms, $R^2$ can also be selected from the group of alkyl, aryl, vinyl, substituted alkyl, substituted vinyl, substituted aryl or any combination of these groups containing 1 to 40 carbon atoms. $R^2$ can also be any organic fragment containing at least one of the following groups; epoxide, anhydride, acid chloride, chloroformate, ketone, aldehyde, carboxylic acid, isocyanate; acrylate or methacrylate ester, acrylamide or an alkyl halide and containing form 3 to 60 carbon atoms.

There are many silanes which can be used in this invention and in a preferred embodiment of this invention the silane is defined as $X—R^1—Si—R^2(R^3)_2$ where:

1. $R^1$ is an alkene group with the general formula $C_nH_{2n}$ where n=0 to 12 or a benzyl group with the formula $CH_2C_6H_4$.
2. X comes from the group: methacryloxy, acryloxy, acetoxy, chloride, bromide, iodide, glycidoxy, carbomethoxy, 4-chlorosulfonylphenyl, isocyanate, chloroformate, carbochloride, 3,4-epoxycyclohexyl or ureido.
3. $R^2$ is either a chloride, an alkoxy with the general formula $OC_nH_{2n+1}$ where n=1 to 12 or a carboxylate with the general formula $O_2CC_nH_{2+1}$ where n=1 to 11.
4. $R^3$ comes from the group chloride, alkoxy with the general formula $OC_nH_{2+1}$ where n=1 to 12, phenyl, cyclohexyl, cylclopentyl and alkyl with the general formula $C_nH_{2n+1}$ where n=1 to 12.

The crosslinking silanes of this invention can be used in any combination as well as in partially or fully hydrolysed states as expected after exposure to water. Also one or more co-crosslinking silanes may be added to the polyamino silane crosslinking formulation. It is not necessary for the co-crosslinking silane to directly attach itself to the polyamino compound as it will be incorporated into the grafted interphase during the crosslinking processes via Si—O—Si bonding with the crosslinking silane directly bonded to the polyamino compound. The co-crosslinking silane is a compound that contains one or more silane groups which are defined by the general formula $SiR^1R^2R^3R^4$ where:

1. $R^1$ and $R^2$ are hydrolysable groups such as alkoxides with the general formula $OC_nH_{2n+1}$ where n=1 to 12, chlorides or carboxylates with the general formula $O_2CC_nH_{2+1}$ where n=1 to 12.
2. $R^3$, $R^4$ can also be hydrolysable groups such as alkoxides with the general formula $OC_nH_{2n+1}$ where n=1 to 12, chlorides or carboxylates with the general formula $O_2CC_nH_{2n+1}$ where n=1 to 12. $R^3$, $R^4$ can also be alkyl, aryl, vinyl, substituted alkyl, substituted vinyl, substituted aryl or any combination of these groups containing 1 to 40 carbon atoms.

Aldol Condensation Products as Crosslinkers

In another preferred embodiment the organic crosslinking agent can contain aldeheyde or ketone functional groups or combinations thereof which can polymerize by an aldol condensation process and the resulting oligomers or polymers can act as crosslinkers for polyamino compounds. Examples of such crosslinking agents are glutaraldehyde, methyl or ethyl-pyruvate, pyruvic aldehyde, methyl or ethyl-levulinate. Also mixtures of aldeheydes and ketones can be used for example formaldehyde, glyoxal or glutaraldehyde can be mixed with ketones or other aldehyde with the general formula $C_nH_{2n+1}CO C_mH_{2m+1}$.where n=1 to 6 and m=0 to 6. The crosslinker can come from any combination of these compounds and the condensation reaction to form the crosslinker can occur on mixing with the polyamino compound or they can be prepared prior to the addition of the polyamino compound using any known acid, base or metal catalyst suitable for aldol condensation reactions.

Methylol Crosslinkers

This group of crosslinkers incorporate reactive methylol groups. They are obtained from the reaction of 2 or more molar equivalents of formaldehyde with one of the following: substituted phenol, melamine, urea, benzoguanamine, or glycouril. Such crosslinkers can be prepared and used as crosslinkers with the aid of acid or base catalysts, which is well known in this field. [Ref Henk van Dijk in "*The Chemistry and Application of Amino Crosslinking Agents or Aminoplasts*", John Wiley and Sons 1999 and T Brukhart, P. Oberressi and P. K. T. Oldring, "*The Chemistry and Appplication of Phenolic Resins or Phenoplasts*, John Wiley and Sons", 1998]. The methylol crosslinkers can be in monomer form, or a self condensed oligomer or polymer form. In a prefered embodiment of this invention the methylol crosslinker is added to a dilute solution of the polyamino compound (<5%).

Crosslinkers Containing at Least Two Oxirane Groups.

Suitable crosslinkers belonging to this group are organic compounds containing at least two oxirane groups. These include compounds containing two and more oxirane groups and homopolymer or copolymer containing poly-oxirane groups. An organic fragment that can be an alkyl, aryl, substituted alkyl or substituted aryl can link the oxiranes.

Suitable compounds containing two or more oxirane groups are but not limited to bisphenol A epoxy resin, di or poly glycidyl ether of diols or polyols, glycidyl ester of a polycarboxylic acid, di or polyglycidyl aliphatic or aromatic amines, or epoxy obtained from peroxidation of unsaturated compounds, homopolymer or copolymer of glycidyl(meth) acrylate. Specific examples consist of bisphenol A epoxy, butanediol diglycidyl ether, triglycidyl isocyanurate, 4,4'-methylenebis-(N,N-diglycidylaniline), glycerol propoxylate triglycidyl ether, diglycidyl 1,2-cyclohexanedicarboxylate, N,N'-diglycidyl-4-glycidyloxyaniline, poly(propylene glycol)diglycidyl ether, poly((phenyl glycidyl ether)-co-formaldehyde), poly(ethylene glycol)diglycidyl ether, 4-vinyl-1-cyclohexene diepoxide, diglycidyl resorcinol ether, 1,2,3,4-diepoxybutane, 1,2,7,8-diepoxyoctane, 1,3 diglycidyl glycerol ether, novalak epoxy resin, poly(dimethylsiloxane) diglycidyl ether terminated, poly[dimethylsiloxane-co-[2-(3,4-epoxycyclohexyl)ethyl]methyl-siloxane], polyglycidylmethacrylate, polyglycidylacrylate, poly(ethylene-co-methyl acrylate-co-glycidyl methacrylate), poly(ethylene-co-glycidyl methacrylate).

An appropriate accelerator or catalysts for the reaction between epoxy and amine can be added to the polyamine formulation. Suitable accelerators are Lewis acid or bases examples of which are but not limited to triethylenediamine (1,4-diazabicyclo[2.2.2]octane), triethanolamine, triethylamine, triethanolamine ethoxylate, tripropylamine, trifluoroboronmono-ethylamine (boron trifluororide-ethylamine complex), tertiary amine, pyridine, 2,4,6-tris(dimethylaminomethyl)phenol, benzyldimethylamine, piperidine, N-hydroxyethylpiperazine, N,N'-dimethylamino phenol, triphenyl phosphine and mixtures of two or more thereof. These catalysts can be used for any oxirane containing crosslinker used in this invention.

Crosslinkers Containing at Least One Oxirane and One acrylate(methacrylate) Groups.

Suitable compounds that belong to this group are organic compounds that contain at least one oxirane and one acrylate (methacrylate) group. The acrylate and the oxirane groups can be linked by an organic fragment which can be an alkyl, aryl, substituted alkyl or substituted aryl. The compounds can contain multi or poly (meth)acrylate and oxirane groups. Compounds containing acrylate and oxirane group are more preferable as the chemical reactivity of acrylate with amine is higher than oxirane so polyamine containing oxirane groups can be formulated and further crosslinked on the oxidized polymer surface.

Such compounds are, for example, obtained by reacting epoxy compound such as those referred to above with one (meth)acrylic acid or by condensing compounds containing (meth)acrylate with hydroxyl or carboxylic groups with epihalohydrins. Specific examples are but not limited to glycidylacrylate, glycidyl methacrylate, epoxy acrylate of bisphenol A, 2-hydroxy-3-(4-oxiranylmethoxy-butoxy)-propyl acrylate, 2-hydroxy-3-[4-[1-methyl]-1-(4-oxiranylmethoxyphenyl)-ethyl-phenoxy]propyl acrylate, aromatic epoxy polyacrylate such as EPON Resin 8021, 8101, 8111, 8121, and 8161 from Shell Chemical Company, Epoxyacrylate Ebecryl 3605(from UCB).

Crosslinkers Containing at Least Two acrylate(methacrylate) Groups.

Suitable crosslinkers of this group are organic compounds containing at least two (meth)acrylate groups. The (meth) acrylate group are linked by an organic fragment which can be an alkyl, aryl, substituted alkyl or substituted aryl. Compounds containing one acrylate and one or more methacrylate groups are preferable because the difference in the rate of reaction between acrylate and methacrylate with amines allows for a formulation with a long pot life. In a typical formulation initial reaction of the amine with acrylate is fast whilst the reaction with methacrylate is slower therefore making the final crosslinking step in solution slower.

Specific examples of these crosslinkers are but not limited to 2-(acryloxy)ethermethacrylate, ethoxylated bisphenol A di(meth)acrylate, polyethylene glycol di(meth)acrylate, 1,3-butylene glycol di(meth)acrylate, propoxylated neopentyl glycol di(meth)acrylate, alkoxylated aliphatic di(meth)acrylate ester, tris(2-hydroxylethyl)isocyanurate tri(meth)acrylate, pentaerythritol tri(meth)acrylate, glycerol propoxylate tri(meth)acrylate, pentaerythritol tetra(meth)acrylate, dipentaerythritol penta(meth)acrylate, di or tri(meth)acrylate methacrylate ester, di or tri(meth)acrylate acrylate ester, aliphatic urethane(meth)acrylate, aromatic urethane(meth) acrylate.

Crosslinker Containing One or More Halogens and One or More Selected from the Group Oxirane, (meth)acrylate, Aldehyde, Isocyanate and Anhydride.

Suitable crosslinkers of this group are organic compounds containing at least one or more halogens and one functional group selected from the groups oxirane, (meth)acrylate, aldehyde, isocyanate and anhydride. The halogen(s) and the other group are linked by an organic fragment which can be an alkyl, aryl, substituted alkyl or substituted aryl.

Examples of suitable compounds are but not limited to epichlorohydrin, epibromohydrin, epiiodohydrin, 2-bromoethyl acrylate, 3-bromopropyl acrylate, 4-bromobutyl acrylate, 6-bromohexyl acrylate, 7-bromoheptyl acrylate, 8-bromooctyl acrylate, 9-bromononyl acrylate, 11-bromoundecyl acrylate, 12-bromododecyl acrylate, 2-chloroethyl acrylate, 2-(2-chloroethoxy) ethyl acrylate, 2-[2-(2-chloroethoxy) ethoxy]ethyl acrylate, 4-chlorobutyl acrylate, 2-chlorocyclohexyl acrylate, 10-chlorodecyl acrylate, 6-chlorohexyl acrylate, 3-chloro-2,2-dimethylpropyl acrylate, 1-chloro-2-methyl-2-propyl acrylate, 8-chlorooctyl acrylate, 3-chloropropyl acrylate, 2-bromoethyl isocyanate, 2-chloroethyl isocyanate, 4-chlorobutyl isocyanate, trichloroacetyl isocyanate, 2-hydroxy-3-(2-chloroethoxy)propyl acrylate, 2-hydroxy-3-(4-chlorobutoxy)propyl acrylate.

For the halogen containing crosslinkers an inorganic acid, organic acid or a mixture of both can be added to the polyamine formulation to increase the pot life of the solution. Preferably an organic acid is added to the polyamine formulation so that the pH is less than 6, if the formulation is required to be stored for more than one day. Suitable acids include but are not limited to, hydrochloric acid, formic acid, acetic acid and oxalic acid.

Crosslinkers Containing One or More Halohydrin Group(s) and One Other Group Selected from Oxirane, (meth)acrylate.

Suitable crosslinkers of this group are organic compounds containing at least one or more halohydrin group(s) and one functional group selected from oxirane, (meth)acrylate, aldehyde. The halohydrin group(s) and the other group are linked by an organic fragment which can be an alkyl, aryl, substituted alkyl or substituted aryl. Suitable compounds are adducts of epihalohydrin with (meth)acrylate hydroxyl, (meth)acrylate acid compounds or adducts of epoxy compounds partially reacted with halogen hydride or epoxy acrylate compounds with halogen hydride. Examples are but not limited to 3-bromo-2-hydroxy propyl acrylate, 3-chloro-2-hydroxy propyl acrylate, 2-(3-chloro-2hydroxy)propoxy-ethyl acrylate, 2-(3-bromo-2-hydroxy)propoxy-ethyl acrylate, 3-(3-chloro-2-hydroxy)propoxy-propyl acrylate, 3-(3-bromo-2-hydroxy)propoxy-propyl acrylate, 4-(3-chloro-2-hydroxy)propoxy-butyl acrylate, 4-(3-bromo-2-hydroxy) propoxy-butyl acrylate, 2-(3-chloro-2-hydroxypropoxycarbonyl)ethyl acrylate, 2-(3-bromo-2-hydroxypropoxycarbonyl)ethyl acrylate.

Crosslinkers Containing at Least Two Anhydride Groups.

In yet another preferred embodiment the crosslinker can contain at least two anhydride functional groups. The anhydride groups can be linked by an alkyl, aryl, substituted alkyl or substituted aryl. The anhydrides can be discrete molecules such as but not limited to pyrromellitic dianhydride, 1,4,5,8-Naphthalenetetracarboxylic dianhydride, 3,4,9,10-perylenetetracarboxylic dianhydride. Anhydride crosslinkers can also be polymeric materials such as but not limited to maleic anhydride copolymers with ethylene, propylene or maleic anhydride grafted onto polymers. These polymers can be homopolymers or copolymers made from many types of monomer units including ethylene, propylene, isoprene, butadiene, methylacrylate, ethylacrylate methacrylate, butylacrylate.

The crosslinker is preferably present in solution at a concentration of less than 5%, preferably 0.001 to 5% and most preferably from 0.01 to 1% by weight.

Any suitable solvent or mixture of solvents can be used in the current invention and a solvent should be chosen that is compatible with polyamine and crosslinker. A preferred solvent, particularly because of occupational safety and environmental considerations is water, particularly with PEI, although the solubility of the crosslinker should also be considered.

Formation of Crosslinked Polyamine Containing Layer on the Natural Polymeric Surface There are two general methods for formation of the polyamino crosslinked surface/interface. The methods are:

A. Premixing the polyamino compound and crosslinker. The polyamino compound and the crosslinker are premixed under suitable conditions. Suppression of crosslinking before application to the oxidised substrate is essential. This can be achieved by preparing the polyamino crosslinking mixture as a dilute solution as is the case of using aldehyde crosslinkers such as glutaraldehyde with PEI. Another way to prevent unwanted crosslinking is to use a crosslinker that requires an external input to proceed, for example, a chemical initiator or catalyst such as water for silane based crosslinkers or a physical input, for example heat for maleated anhydride crosslinkers. Also crosslinking can be controlled by varying the reactivity of the functional groups for example by using a combination of relatively reactive acrylate functional groups with less reactive methacrylate or epoxide groups. The extent of crosslinking in solution can also be minimised by mixing the polyamino compound and crosslinker just prior to contact with the natural polymeric surface.

B. Step wise addition of the polyamino compound and the crosslinker. This method is particularly suitable for crosslinkers that rely on, very reactive functional groups, such as acid chlorides or isocyanates. The polyamino compound can be applied to the surface first and the crosslinker applied afterwards.

The polyamino/crosslinking solutions can be applied by many standard methods which include but are in no way limited to spray coating, dipping, roll coating, meniscus coating, spin coating, gravure coating etc. Once the solution is applied the solvent can be evaporated off either under ambient conditions or at elevated temperatures using an oven, infrared radiation or any other common method. On the other hand excess solution can be removed by washing with clean water or another solvent or blown off using a high pressure gas such as compressed air. The time taken between the contact of the grafting solution with the polymeric substrate and drying is from 0.001 seconds to 4 hours. When dip coating is used an external physical field such as ultrasonication can be applied during dipping to enhance the grafting of polyamino compounds. After the polyamino compound is adsorbed on the surface a suitable physical fields such as heat, IR, microwave, etc can be used to enhance or initiate the crosslinking reaction of the polyamino compounds.

The polyamine and crosslinking agent are preferably applied to the substrate surface at a rate of less than 2 g of the total of polyamine and crosslinker per square metre of surface area. Generally the thickness of the crosslinked network will be less than 3 microns.

Subjecting the Natural Polymeric Material to Extraction [Step i]

The method of the invention may include a step of subjecting the natural polymeric material to extraction to reduce the content of extractable material therein. The extraction process will preferably be carried out prior to treatment with the modifying agent.

The step of subjecting the natural polymeric material to extraction is particularly preferred when the natural polymeric material is a cellulosic material and is most preferred where the cellulosic material is in the form of a softwood.

Natural cellulosic material may be chemically treated in order to remove lignin-containing materials such as pectin, waxy substances and natural oils covering the external surface of the fibre cell wall. this reveals the fibrils and gives a rough surface topography to the fibre. Alkali metal hydroxide particularly sodium hydroxide (NaOH), is the most preferred chemical for cleaning the surface of plant fibres and extracting resinous materials. The extraction step may also change the fine structure of the native cellulose I to cellulose II by a process known as mercerisation. The reaction of sodium hydroxide with cellulose may be represented as follows:

$$\text{Cell—OH}+\text{NaOH}\rightarrow\text{Cell—O}^{-}\text{Na}^{+}+\text{H}_2\text{O}+[\text{Surface impurities}]$$

Mercerisation may depolymerise the native cellulose I molecular structure producing short length crystallites. Mercerisation may be defined as the process of subjecting a vegetable fibre to the action of an aqueous solution of a strong base and may produce swelling with resultant changes in the fine structure, dimension, morphology and mechanical properties.

The optimum concentration of alkali metal hydroxide and other processing parameters will depend on factors such as the temperature used and the origin of the cellulosic fibre. The concentration will generally be from 0.05 to 50%. Mercerisation of plant fibres effectively changes the surface topography of the fibres and their crystallographic structure. Care should be exercised in selecting the concentration of alkali metal hydroxide for mercerisation as some fibres have reduced thermal resistance at certain NaOH concentrations.

Mercerisation improves accessibility of reactive sites to the modifying agent bringing about crystalline modification which involves fibril swelling and sometimes improves the crystalline packing order which has the advantage of providing more access to penetrating chemicals. The presence of reactive sites and fibril swelling are preferred for providing cross-linking inside the fibre. Cellulose-based fibres absorb moisture causing both reversible and irreversible swelling. In composite products this can result in undesirable dimensional changes.

The removal of surface impurities on plant fibres may be an advantage for fibre to matrix adhesion as it may facilitate both mechanical interlocking and the bonding reaction due to the exposure of the hydroxyl to chemicals such as the modifying agent.

The solvent used to extract unwanted products from the cellulosic material may be applied at an elevated temperature and even at temperatures up to or greater than its boiling point. The use of steam, optionally in the presence of alkali, may be advantageous in some cellulosic materials.

When alkali is used in the extraction process the treated cellulosic material may be neutralised. The final pH may be used to control the charges present on the surface of the cellulosic material.

The application of a static and/or alternating physical field may be used to enhance penetration of natural cellulosic material by the chemicals used in the extraction process.

Application of Static and/or Alternating Physical Field [Step ii]

The invention may and preferably will, include the application of a static and/or high frequency alternating physical field. The field may be applied before, during or after use of the modifying agent and may be used to enhance the results provided in other steps. The field may, for example, be used to enhance solvent extraction by improving interaction between the natural polymeric material (particularly in the case of cellulosic material) and extraction chemicals. Examples of these fields include an ultrasonic field, a microwave field, a radio-frequency field and heat energy. The preferred ultrasonic field has a frequency in the range of from 1 to 500 kHz. The preferred microwave field has an energy range from 1 GHz to 300 GHz. The preferred radio-frequency field has a frequency in the range of from 10 kHz to 1 GHz. The preferred temperature is in the range is at least 30 degrees celsius and more preferably, from 50 to 150 degrees celsius.

Modification of Natural Polymeric Substrate [Step iii]

Many suitable methods may be used to modify at least part of a natural polymeric material to improve its interaction with polyamino compounds. The most preferred treatment is oxidation of the polymer surface but other surface modification methods such as sulfonation with sulfur trioxide gas, or halogenation can also lead to a surface suitable for the grafting of polyamino compounds. Oxidation techniques which can be used for this invention include for example corona discharge, flame treatment, atmospheric plasma, non-depositing plasma treatment, chemical oxidation, UV irradiation and/or excimer laser treatment in the presence of an oxidising atmosphere such as: air, oxygen ($O_2$), ozone ($O_3$), carbon dioxide ($CO_2$), Helium (He), Argon (Ar), and/or mixtures of these gases. However, for the present technique of an electrical discharge for instance corona discharge or atmospheric plasma, flame treatment, ozone, UV treatment chromic acid treatment, halogenation or combination thereof are preferred.

Suitable corona discharge energies range from 0.1-5000 mJ/mm$^2$ but more preferably 2-800 mJ/mm$^2$. Corona discharge treatment may be carried out in the presence of the following atmospheres: air, oxygen ($O_2$), ozone ($O_3$), carbon dioxide ($CO_2$), Helium (He), Argon (Ar), and/or mixtures of these gases. Suitable treatment times and discharge energies can be calculated using the following equations:

$$t=d/v_1 (\text{or } v_2)$$

and $$E=Pn/lv_1$$

or $$E=Pn/lv_2$$

t=treatment time for a single pass of treatment under the electrode
d=electrode diameter
E=discharge energy
P=power energy
n=number of cycles of treated substrate moving under the electrode
l=length of treating electrode
$v_1$=speed of treating table
$v_2$=speed of conveyor tape (i.e. continuous treatment)

Monomeric or polymeric forms of surface modifying agents according to this invention may be present in the electrical discharge zone either as vapours, aerosols, suspensions alone or any combination thereof.

When non-depositing plasma glow discharge treatment is used, the range of suitable energy is 5-5000 Watts for 0.1 seconds to 30 minutes, but more preferably 20-60 Watts for 1 to 60 seconds. Preferable gases are air, oxygen, water or a mixture of these gases.

Alternatively, any known flame treatment may be used to initially oxidise at least part of the surface of the natural polymeric material. The range of suitable parameters for the flame treatment are as follows: the oxygen ratio (%) detectable after combustion from 0.05% to 5%, preferably from 0.2% to 2%; treatment speed from 0.1 m/min to 2000 m/min, preferably from 10m/min to 100 m/min; treatment distance from 1 mm to 500 mm, preferably from 5 mm to 100 mm. Many gases are suitable for flame treatment. These include, but are not limited to: natural gases, pure combustible gases such as methane, ethane, propane, hydrogen, etc or a mixture of different combustible gases. The combustion mixture also includes air, pure oxygen or oxygen containing gases.

Monomeric or polymeric forms of surface modifying agents in accordance with this invention may be present as an admixture with combustable gases or the air or mixtures of these as used for flame oxidation and can be present in the form of vapours, sprays, aerosols or suspensions during combustion or may be alternatively present in the vicinity of flame during combustion in such distance as to enable a complete or partial evaporation of any or all of components of such combustion gas mixtures or that of the vapour, spray, aerosol or suspension of modifying agents according to this invention.

Surface or interior oxidation can also be carried by ozone and/or other oxidizing gases, UV radiation, electron beam, excimer laser and/or other form of radiation.

Similarly, chemical oxidation of at least part of a natural polymeric substrate can be effected with any known, standard etching solutions, such as chromic acid, potassium chlorate-sulfuric acid mixtures, chlorate-perchloric acid mixtures, potassium permanganate-sulfuric acid mixtures, nitric acid, sulfuric acid, peroxodisulphate solution in water, chromium trioxide, or a dichromate solution in water, chromium trioxide dissolved in phosphoric acid and aqueous sulphuric acid, etc. More preferably, chromic acid treatment is used. The time taken to complete the treating process can vary between 5 seconds to 3 hours and the process temperature may vary from room temperature to 100° C.

When the modifying agent is an organo silane it is particularly preferred that an oxidation step is included.

Alternatively, halogenation may be used to modify at least part of natural polymeric substrate with a halogenating agent to improve the interaction of substrate with polyamino compounds. The halogenation treatment is more preferable for polymer being any natural or synthetic rubber. Suitable halogenating agent may be an inorganic and/or organic halogenating agents in an aqueous or non-aqueous or mixed solvents.

Examples of suitable inorganic halogenating agents include fluorine, chlorine, iodine, and bromine as pure gas or any mixture with nitrogen, oxygen, argon, helium or in solutions and acidified hypochlorite solutions. Suitable organic halogenating agents include but not limited to N-halohydantoins, N-haloimides, N-haloamides, N-chlorosulphonamides and related compounds, N,N'-dichlorobenzoylene urea and sodium and potassium dichloroisocyanurate. Specific examples are 1,3-dichloro-5,5-dimethyl hydantoin; 1,3-dibromo-5,5-dimethyl hydantoin; 1,3-dichloro-5-methyl-5-isobutyl hydantoin; 1,3-dichloro-5-methyl-5-hexyl hydantoin, N-bromoacetamide, tetrachloroglycoluril, N-bromosuccincimide, N-chlorosuccinimide, mono-, di-, and tri-chloroisocyanuric acid. Trichloroisocyanuric acid is especially preferred. The halogenation may be carried out at room temperature or at elevated temperature in gas phase or in solution with or without the use of ultrasonication energy. More specified treatment conditions are referred to U.S. Pat. No. 5,872,190 and the related prior art.

The natural polymeric material is preferably an article and the oxidation technique and method of oxidation may be chosen to provide any surface modification or to modify the natural polymeric material throughout the article. Selective surface modification is preferred where it is desired to improve bonding to other materials while maintaining the bulk properties of the natural polymeric material based article.

Functional Crosslinked Interphase-Interface Systems and the Adhesion of Coatings This invention allows for the preparation of a predefined multifunctional interface/interphase which can be designed to optimise specific interactions with various functional coatings or molecules. These coatings can have a thickness in the order of a molecular monolayer to a few millimeters and in a preferred embodiment of this invention the functional coatings are applied after the modifying agent has been grafted to the surface of the natural polymeric substrate. The functional interphase/interface systems and coatings may impart on the substrate many different properties which include but are not limited to the following:

- conductivity either electrical or ionic
- controlling surface wettability
- improved adhesion of adhesives, organic-, inorganic-, and metallic coatings and synthetic and natural resins
- barrier properties
- biofunctionality eg. protein repellency, biocide/fungicide properties
- improved surface hardness
- slip enhancement or slip reduction
- absorption or reflection of UV-vis, IR, MW or RF
- photovoltaic properties The coatings may also have a decorative and/or informative function such as paint, varnishes, lacquers and printing inks. The coating can also be an adhesive for the joining of the treated polymer substrate to another material. I For those experienced in the art, knowledge of the components of a coating can be used to determine what type of polyamino/crosslinker will provide optimal interactions. For example it is well known that polyvinyl alcohol (PVOH) can be used as barrier coatings, hindering permeability of gases and vapours for packaging materials. A major factor that governs the successful use of PVOH is its adhesion to substrates. It is also well known that aldehydes bond to polyvinyl alcohols, thus a polyamino network crosslinked with glutaraldehyde will provide free aldehyde groups which will lead to bond formation with PVOH based coatings.

Another advantage of this invention is that grafted polyamino compounds crosslinked with silanes will form strong bonds with silanes present in coating, adhesive or sealant formulations a situation which is common in many commercial formulations today. Another common component in many commercial formulations is melamine, urea, benzoguanamine, or glycouril, thus an aldehyde containing crosslinker would be compatible with such formulations.

Another important application area is improving the interaction between natural polymeric based substrates and metallic coatings such as aluminium, copper, platinum, silver, gold etc. With this invention improved adhesion at the natural polymer substrate/metallic coating interface is obtainable using a variety of polyamino crosslinked formulations where strong interactions are expected between the amino groups and the metallic coatings. The interactions between the crosslinked surface modifying agent eg polyamino compound or organo-functional coupling agent surface and metal coatings such as aluminium, nickel, chromium, copper, platinum, silver or gold, could be further improved if sulfur compounds were present in the crosslinked structure, which could be easily achieved using a polyamino system crosslinked with a silane and a silane co-crosslinker that contains sulfur groups, such as mercaptopropyl trimethoxysilane or bis[(triethoxysilyl)propyl]tetrasulfane.

Also the adhesion of inorganic oxides or inorganic salts on natural polymers may be enhanced by this invention if the crosslinkers contained, for example, silanes or beta-diketones, a well known metal binding group which would be present if methylpyruvate was used as a crosslinker.

In another embodiment, this invention provides a very useful and cost effective method to engineer on a natural polymeric material a crosslinked surface containing highly reactive functional groups for multi step surface coupling of molecules possessing specific physico-chemical properties. Groups available include amine group or other functional group from the polyamine or organofunctional coupling agent and other functionalities from the crosslinkers and co-crosslinkers. Suitable compounds for multi step surface coupling are molecules containing reactive groups selected from acidic group (carboxylic, sulfonic, phosphoric/phosphonic), (meth)acrylate, epoxy, aldehyde, hodroxyl, thio, isocyanate, isothiocyanate, anhydride, halide. These compounds can be small molecules with 2 to 60 carbon atoms, or macromolecules with molecular weight ranged from a few hundreds to a few millions. They can also be inorganic species such as metal salts, oxides or chelate complexes.

The process for this multi step surface grafting is:

A) providing surface of a natural polymeric based article with functionalities by suitable oxidation method B) contacting the surface with a polyamine or organo-functional coupling agent formulation C) contacting molecules of interest with the surface Highly water-wettable surface on the natural polymeric substrate can be made by contacting the surface during "step C" with solution containing ionic and no ionic water soluble macromolecules. Macromolecules of interest include polysacharides, homopolymer or copolymers made from acrylic acid, vinylsulfonic acid or 4-styrenesulfonic acid, polymetaphosphoric acid, polyvinyl alcohol, or amino-acids. Preferably the macromolecules should contain acrylate or aldehyde and carboxylic groups such as modified dextran, polyacrylic acid, modified polyvinyl alcohol, poly(acrylic acid-co-acrylamide). Catalyst for activation of acid group such as carbodiimide, N-hydroxy-succimidyl can be used to improve the chemical coupling of acidic containing molecules.

Antifouling and/or antibacterial surface can be made by contacting the surface during "step C" with solution containing polyethylene glycol, polypropylene glycol, peptides, lysozyme. Preferable compounds are polyethylene glycol mono or diacrylate, polyethylene glycol mono or diglycidyl, are polyethylene glycol mono or dialdehyde.

The bio-activity/bio-compatibility of polymer can be improved by contacting the polymer surface "during step C" with bio-active/bio-compatible molecules. It is well known that polyglutaraldehyde can covalently bind amino groups thus a polyamino/glutaraldehyde crosslinked system containing excess glutaraldehyde would be an excellent surface for binding bioactive molecules such as peptides, proteins or enzymes. Other materials, commonly known as preservatives, can be used in accordance with this invention.

UV/IR inhibitor, absorbers, or fluorescent compounds can be grafted onto the surface during "step C" to provide an effective method to reduce UV or laser damage of the substrate and either absorb or reflect radiation.

The invention will now be described with reference to the following examples. It is to be understood that the examples are provided by way of illustration of the invention and that they are in no way limiting to the scope of the invention.

EXAMPLE 1

This examples demonstrates the use of the invention to improve bonding to timber.

Samples of wood products may be treated using a treatment line which includes the following stations:

1. Flame treatment at about 15 to 70 m/min
2. Application of an aqueous solution of an amino saturated organo silane as a spray
3. Use of air knife at 80° C. using IR or hot air Flame oxidation used an air/propane mixture providing 0.2 to 2% oxygen excess. Treatment speed may be 20 to 150 m/min.

The treated timber exhibits improved adhesion with commonly used timber adhesives such as phenol-formaldehyde, polyurethane, PVA, or epoxy adhesive. The silane solution was a 1:3 mixture (silane:water) mole ratio prepared 24 hours before use. The hydrolysed silane is diluted with water or isopropanol to obtain a 0.05 to 1% solution.

EXAMPLE 2

The method of Example 1 was repeated using corona discharge or UV radiation or ozone in place of flame oxidation. The condition for corona discharge treatment were as follows:

| | |
|---|---|
| Power Output | 1 kw maximum |
| Frequency | 13-30 $kZ_2$ |
| Speed | 0.1 to 70 m/min |

The distance between the substrate and electrode was 2.5 mm.

UV radiation and ozone exposure were achieved by the use of a UV source (Fusion UV), and were used instead of corona treatment. The treatment speed for UV and ozone treatment was 2 m/minute.

EXAMPLE 3

This example explains the influence of surface modification of various types of wood species on surface properties, such as components of surface energy (dispersive and polar) the latter being relevant to the quality of adhesion. The influence of these treatments on the retention of surface properties upon storage for a period of two weeks under various storage conditions is also explained.

Types of wood species:

pine mountain ash oak meranti

Treatments

1. As received
2. Flame only
3. 1% NaOH leaching at 80° C.
4. 1% NaoH leaching at 80° C. and Flame
5. Treatment (2)+0.25% PEI ($M_w$=50,000)
6. Treatment (3)+0.25% PEI ($M_w$=50,000)
7. Treatment (4)+0.25% PEI ($M_w$=50,000).

PEI was used as water-based solution.

TABLE A

Surface energy of wood in relation to various types of surface treatment [γP] polar component; [γ TOTAL]: total surface energy

| Timber | Treatment | Surface Energy [mJ/m²) Freshly Treated Wood | | Storage (2 Weeks/ 30° C.] | |
|---|---|---|---|---|---|
| Type | No. | γP | γ TOTAL | γP | γ TOTAL |
| Pine | 1 | 15 | 53 | 3 | 42 |
| | 2 | 27 | 63 | 20 | 58 |
| | 3 | 20 | 57 | 13 | 52 |
| | 4 | 29 | 67 | 28 | 67 |
| | 5 | 10 | 48 | 10 | 48 |
| | 6 | 10 | 49 | 10 | 49 |
| | 7 | 14 | 52 | 14 | 52 |

TABLE A-continued

Surface energy of wood in relation to various types of surface treatment [γP] polar component; [γ TOTAL]: total surface energy

| Timber | Treatment | Surface Energy [mJ/m²] Freshly Treated Wood | | Storage (2 Weeks/ 30° C.] | |
|---|---|---|---|---|---|
| Type | No. | γP | γ TOTAL | γP | γ TOTAL |
| Oak | 1 | 11 | 50 | 0 | 40 |
| | 2 | 38 | 74 | 5 | 45 |
| | 3 | 20 | 58 | 11 | 50 |
| | 4 | 38 | 72 | 15 | 53 |
| | 5 | 11 | 49 | 8 | 46 |
| | 6 | 11 | 50 | 10 | 48 |
| | 7 | 14 | 53 | 14 | 53 |
| Mountain Ash | 1 | 6 | 45 | 0 | 40 |
| | 2 | 25 | 64 | 15 | 53 |
| | 7 | 14 | 54 | 12 | 50 |
| Meranti | 1 | 12 | 51 | 2 | 41 |
| | 2 | 31 | 71 | 22 | 50 |

The following is observed and concluded upon analysis of results in Table A:

1. Oxidation of wood surface by flame treatment increases surface polarity of wood.
2. Leaching of wood surface by 1% NaOH solution improves surface polarity of wood in comparison with unleached wood. This is attributed to the removal of soluble substances and extractive from cellulose fibre surface.
3. Surface oxidation by flame of leached wood results in increase of surface polarity of treated wood in comparison with untreated or leached only wood.
4. Surface grafting of polyfunctional amines (PEI) onto the wood surface functionalises the surface of cellulose. This is signified by surface polarity (approx. 10 to 14 mJ/m²) of the modified wood, which reflects the inherent specific polarity of surface-grated PEI's.
5. The stability of surface-modified wood upon storage can be ranked as follows:

| | |
|---|---|
| as received: | very poor |
| flame of NaOH leaching: | moderate |
| surface-grafted with PEI: | very good |

EXAMPLE 4

In this example the influence of wood surface treatment type on the quality of paint adhesion is demonstrated.

Types of Wood:

pine mountain ash

Paint: acrylic "Ponderose Prime"

Treatment types:

1. Untreated
2. Flame only
3. Flame+0.25% PEI ($M_w$=50,000)
4. Leaching (1% NaOH)+Flame+0.25% PEI PEI was used as water-based solution.

To determine the quality of surface treatment on paint adhesion, the wood samples were painted subsequent to treatments 1 to 4. Paint adhesion was assessed in accordance with ASTM D 4541-89 standby adhesive bonding of aluminium dolly to painted surface, and pull-off test. The strength of adhesion [Mpa] and [%] of cohesive wood failure (% CF) were assessed. Paint adhesion was assessed in dry condition and after artificial simulated by aging achieved through by 8 days immersion in 60° C. water.

TABLE B

Paint adhesion quality upon various types of surface treatment

| Timber Type | Treatment Type | Surface Energy [mJ/m²] Dry Adhesion Strength Mpa | Wood CF % | Days in 60° C. water Strength MPa | Wood CF % |
|---|---|---|---|---|---|
| Pine | 1 | 3.9 | 65 | 3.1 | 43 |
| | 2 | 3.1 | 42 | 2.5 | 45 |
| | 3 | 3.3 | 37 | 3.0 | 77 |
| | 4 | 4.0 | 80 | 3.1 | 98 |
| Mountain Ash | 1 | 2.4 | 12 | 3.6 | 35 |
| | 2 | 1.9 | 12 | 3.4 | 47 |
| | 3 | 2.6 | 50 | 3.7 | 52 |
| | 4 | 3.9 | 80 | 3.8 | 75 |

The results presented in example B demonstrate the following:

(a) Flame treatment of wood does not increase the "dry" strength of paint adhesion, but slightly improves the performance of pain adhesion upon exposure to water (immersion);

(b) Surface grafting of polyfunctional amine (PEI) onto oxidized wood surface results in the following:
- significant improvement of durability of paint adhesion in wet condition for both softwood and hardwood;
- moderate improvement of dry and wet paint adhesion on softwood;
- significant improvement of dry paint adhesion to hardwood;

(c) surface grafting of polyfunctinal amine onto leached and oxidized wood results in excellent improvement of both "dry" and "wet" strength of paint adhesion for both types of wood, softwood and hardwood.

EXAMPLE 5

This example demonstrates the improvement of UV-stability of surface-modified wood and paper subsequent to surface treatment in accordance with this invention.

The following substrates were used:

Photocopying paper—white (Reflex)

Poplar veneer (0.5 mm thick)

The substrates were oxidized were oxidized with corona this dosage treatment and contacted with two types of graft chemicals:

1. PEI (2% in water)
2. (i) PEI (2%) with attached molecules of dansyl chloride (DC)
   (ii) PEI, as above with attached molecules of Lucifer Yellow (CH).

Subsequent to the above, substrates were exposed to a UV bulb (Fusion UV corning) and passed at slow speed on the conveyer. The distance between the bulb and substrate was 65 mm. The effectiveness of UV protection resulting from surface modification according to this invention was assessed usually by assessment of substrate colour change upon exposure to UV radiation.

The results are listed in Table C.

TABLE C

UV Stability of Cellulosic Substrate Surface

| Substrate Type | Treatment | Surface Colour: Initial | Surface Colour: Conveyor: 1 m/mm | Surface Colour: Conveyor: 0.1 m/mm |
|---|---|---|---|---|
| Paper | untreated | White | Light Brown | Brown |
| | corona/PEI | White | Yellow | Light Brown |
| | as above + DC/CH | White | v. Light Yellow | Yellow |
| Wood Veneer | untreated | Light Yellow | Brown | Dark Brown |
| | corona/PEI | Light Yellow | Yellow | Light Brown |
| | as above + DC/CH | Light Yellow | Light Yellow | Yellow |

EXAMPLE 6

This example demonstrates the effectiveness of the invention with regard to providing the following properties to the surface of cellulosic substrate:

1. Electro-conductivity and charge transfer
2. Antistatic surface properties
3. Controlled surface charge.

The following materials were used:

Substrates: white photocopying paper (Reflex)

cellulose/calcium carbonate-filled artificial paper (polypropylene matrix).

The following surface treatments were used:

1. Untreated substrate
2. Flame treatment only
3. Flame+PEI (Mw=800) at 0.1%
4. Flame+bi-amino silane=0.5% (Dow Corning Z-6020)
5. Flame+tri-amino silane=0.5% (Whittco A 1130)
6. Flame+PEI (Mw=800): 0.5%
7. Flame+PEI (Mw=800): 2.0%
8. Flame+(0.5% PEI/Mw=800)+0.02 M $H_3PO_4$ ($H_3PO_4$ used for controlling PEI protonation degree)
9. Flame+(0.5% PEI/Mw=800)+0.04 M $H_3PO_4$ ($H_3PO_4$ used for controlling PEI protonation) but 0.04 $MH_3PO_4$ used.

All graft chemicals were used as water-based solutions.

The results on surface conductivity of substrates are listed in Table D.

TABLE D

Substrate Surface Electron-Conductivity after treatment [Siemens $\times 10^{-9}$ per square]

| Treatment | Surface electron conductivity: "Artificial Paper" | Surface electron conductivity: Reflex Paper | Surface electron conductivity: Reflex paper: laminated with PP |
|---|---|---|---|
| 1 | 0 | 0 | 0 |
| 2 | 0 | 0 | 0 |
| 3 | 0.01 | 0.003 | 0.01 |
| 4 | 0.166 | 0.100 | 0.166 |
| 5 | 0.300 | 0.22 | 0.305 |
| 6 | 0.175 | 0.12 | 0.175 |
| 7 | 0.625 | 0.400 | 0.625 |
| 8 | 0.25 | 0.18 | 0.25 |
| 9 | 0.08 | 0.05 | 0.08 |

The results presented in Table D demonstrate the effectiveness of polyamino-functional graft chemicals, such as bi- and tri-amino-silanes and PEI's as materials suitable for the provision and control of electro-conductivity, charge conductivity and degree of protonation of surface of cellulose-containing materials in accordance with this invention. The above properties can be effectively used for providing surface conductivity or antistatic properties of cellulose-based or other natural polymer-based products including, but not limited to, flexible films, woven fabrics, rigid substrates and others.

The invention claimed is:

1. A method for modifying the surface of a natural polymer substrate to improve its bonding with an adhesive or coating, the method comprising:

activating the surface of the natural polymer substrate for reaction with a modifying agent by treatment of the natural polymer substrate with an aqueous metal hydroxide composition;

contacting the activated surface with a modifying agent, wherein the modifying agent includes a multifunctional amine containing organic compound to provide a modified natural polymer surface having modifying agent functional groups grafted thereto, wherein the modifying agent is applied in the form of a spray, vapor or aerosol; and contacting the modified natural polymer surface with an adhesive or coating to form a bond between the natural polymer surface and said adhesive or coating.

2. A method according to claim 1, wherein the treatment of the surface of the natural polymer substrate with the aqueous metal hydroxide composition allows penetration of the modifying agent into the surface of the substrate.

3. A method according to claim 2, wherein the surface of the natural polymer substrate is treated with the aqueous metal hydroxide composition and the aqueous metal hydroxide composition comprises at least an alkali metal hydroxide.

4. A method according to claim 3, wherein the alkali metal hydroxide is sodium hydroxide.

5. A method according to claim 2, wherein the aqueous metal hydroxide composition is applied to the surface of the natural polymer substrate from a solution or steam.

6. A method according to claim 1, wherein the modifying agent comprises the multifunctional amine containing organic compound and a crosslinker reactive with the multifunctional amine containing organic compound to form a crosslinked layer on the surface of the natural polymer substrate.

7. A method according to claim 6, wherein the crosslinker is a compound having at least two functional groups including a first functional group reactive with an amino functional group of the multifunctional amine containing organic compound and a second functional group reactive with a functional group present in at least one of the multifunctional amine containing organic compound and the crosslinker.

8. A method according to claim 7, wherein the crosslinker is selected from the group consisting of:

aldol condensation products selected from the group consisting of glutaraldehyde, methyl pyruvate, ethylpyruvate, pyruvic aldehyde, methyl levulinate, ethyl levulinate and mixtures of at least one of formaldehyde, glyoxal and glutaraldehyde with one or more ketone of formula $C_nH_{2n+1}CO\ C_mH_{2m+1}$ wherein n and m are independently selected from 0 to 6; methylol crosslinkers provided by reaction of two or more molar equivalents of formaldehyde with at least one compound selected from the group consisting of phenol or substituted phenol, melamine, urea, benzoguanamine and glucouril;

oxiranes selected from the group consisting of bisphenol A epoxy resins; di and poly glycidyl ethers of diols and polyols; glycidyl esters of polycarboxylic acids; di or poly glycidyl aliphatic or aromatic amines;

epoxy compounds obtained from peroxidation of unsaturated compounds; homo and copolymers of glycidyl methacrylate; homo and copolymers of glycidyl acrylate; epoxy acrylate compounds and epoxy methacrylate compounds;

polyunsaturated compounds selected from the group consisting of 2-(acryloxy)ethermethacrylate; ethoxylated bisphenol A di(meth)acrylate; polyethylene glycol di(meth)acrylate; 1,3-butylene glycol di(meth)acrylate; propoxylated neopentyl glycol di(meth)acrylate; alkoxylated aliphatic di(meth)acrylate ester; tris(2-hydroxylethyl)isocyanurate tri(meth)acrylate; pentaerythritol tri(meth)acrylate; glycerol propoxylate tri(meth) acrylate; pentaerythritol tetra(meth)acrylate; dipentaerythritol penta(meth)acrylate; di or tri(meth) acrylate methacrylate ester; di or tri(meth)acrylate acrylate ester; aliphatic urethane(meth)acrylate and aromatic urethane(meth)acrylate;

halogen containing compounds selected from the group consisting of epichlorohydrin, epibromohydrin, epiiodohydrin; 2-bromoethyl acrylate; 3-bromopropyl acrylate; 4-bromobutyl acrylate; 6-bromohexyl acrylate; 7-bromoheptyl acrylate; 8-bromooctyl acrylate; 9-bromononyl acrylate; 11-bromoundecyl acrylate; 12-bromododecyl acrylate; 2-chloroethyl acrylate; 2-(2-chloroethoxy)ethyl acrylate; 2-[2-(2-chloroethoxy) ethoxy]ethyl acrylate; 4-chlorobutyl acrylate; 2-chlorocyclohexyl acrylate; 10-chlorodecyl acrylate; 6-chlorohexyl acrylate; 3-chloro-2,2-dimethylpropyl acrylate; 1-chloro-2-methyl-2-propyl acrylate; 8-chlorooctyl acrylate; 3-chloropropyl acrylate; 2-bromoethyl isocyanate; 2-chloroethyl isocyanate; 4-chlorobutyl isocyanate and trichloroacetyl isocyanate;

compounds containing at least one halohydrin group and at least one group linked to the halohydrin group by an organic fragment, wherein the at least one group is selected from the group consisting of oxirane, acrylate, methacrylate and aldehyde; and compounds containing two or more anhydride groups selected from the group consisting of pyrromellitic dianhydride, 1,4,5,8-naphthalenetetracarboxylic dianhydride, 3,4,9,10-perylenetetracarboxylic dianhydride and polymers containing maleic anhydride.

9. A method according to claim 1, wherein the modifying agent comprises the multifunctional amine containing organic compound and a crosslinker reactive with the multifunctional amine containing organic compound.

10. A method according to claim 1, wherein the surface of the natural polymer substrate is processed with an extraction process prior to contacting the surface with the modifying agent.

11. A method according to claim 1, wherein the modifying agent comprises a multifunctional amine containing organic compound which is selected from non-polymeric compound selected from the group consisting of: $C_2$ to $C_{36}$ linear, branched or cyclic compounds containing two or more amine groups being primary or secondary amines; and polyamines being polymers of a number average molecular weight of from 300 to 3 million containing a multiplicity of amine groups.

12. A method according to claim 11, wherein the polyamine is a polyethylenimine, polyvinylamine or polyallylamine of molecular weight of from 300 to 3 million.

13. A method according to claim 1, wherein the modifying agent is a multifunctional amine containing compound and a cross-linking agent reactive to the amine to provide a cross-linked network grafted to the surface of cellulosic material.

14. A method for modifying the surface of a natural polymer substrate to improve its bonding with an adhesive or coating, the method comprising activating the surface of the natural polymer substrate for reaction with a modifying agent by treatment of the natural polymer substrate with an aqueous metal hydroxide composition; and contacting the activated surface with a modifying agent, wherein the modifying agent includes a multifunctional amine containing organic compound to provide a modified natural polymer surface having modifying agent functional groups grafted thereto; and contacting the modified natural polymer surface with an adhesive or coating to form a bond between the natural polymer surface and said adhesive or coating.

* * * * *